United States Patent [19]

Larrain

[11] Patent Number: 4,488,470

[45] Date of Patent: Dec. 18, 1984

[54] DRUM STICKS

[76] Inventor: James A. Larrain, 103 Greenbrook Dr., Brandon, Miss. 39042

[21] Appl. No.: 422,549

[22] Filed: Sep. 24, 1982

[51] Int. Cl.[3] ..... G10D 13/02

[52] U.S. Cl. ..... 84/422 S; D17/22

[58] Field of Search ..... D17/22; 84/422 S

[56] References Cited

U.S. PATENT DOCUMENTS

| | | | |
|---|---|---|---|
| 1,484,777 | 2/1924 | Hassenpflug | 84/422 S |
| 3,489,052 | 1/1970 | Colyer et al. | 84/422 S |
| 4,300,438 | 11/1981 | Handal | 84/422 S |
| 4,385,544 | 5/1983 | Heiskell | 84/422 S |

FOREIGN PATENT DOCUMENTS

| | | | |
|---|---|---|---|
| 620637 | 5/1961 | Italy | 84/422 S |
| 4144 | 9/1968 | Netherlands | 84/422 S |

*Primary Examiner*—Lawrence R. Franklin

*Attorney, Agent, or Firm*—Carl B. Fox, Jr.

[57] ABSTRACT

Drum stick having serially disposed length portions of reducing diameter from the butt end to the tip end of the drum stick, the handle end of the drum stick having surface interruptions to facilitate handling of the drum stick without slippage.

11 Claims, 4 Drawing Figures

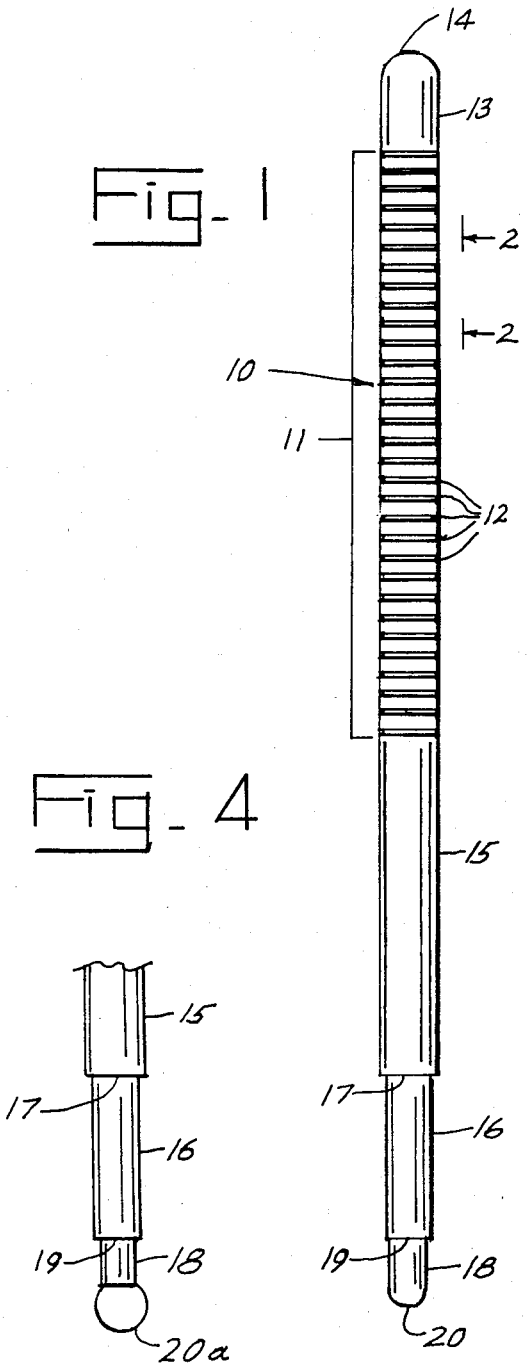
Fig. 1
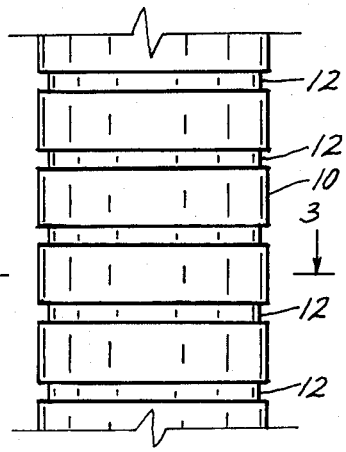
Fig. 2
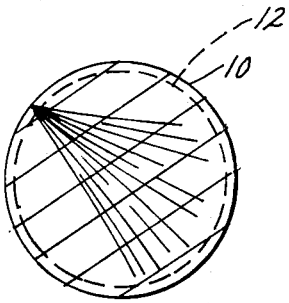
Fig. 3
Fig. 4

DRUM STICKS

BACKGROUND OF THE INVENTION

Drum sticks are provided in a variety of forms. Most drum sticks have a smooth cylindrical butt end portion which serves as the handle, and from the inner end of which the stick tapers to a smaller end which is rounded at its tip or which is often provided with an enlarged generally spherical tip formation to engage the drum surface. Such conventional drum sticks are subject to breakage and tend to slip from the hands, especially when perspiration is present on the hands. In addition, the elongate tapered forms of conventional drum sticks makes them relatively expensive. This invention seeks to provide drum sticks of improved design, which are durable, which have frictional handle surfaces which are easily held onto despite perspiration on the hands, and which are inexpensive to manufacture.

SUMMARY OF THE INVENTION

The drum sticks of improved design provided by the invention consist of integral elongate sticks having a series of adjacent cylindrical surfaces, being largest at the handle end and being reduced stepwise to the tip. The handle portion has a plurality of equally spaced circular grooves therearound which assist in the holding thereof, even if the hand is wet, and the intermediate sections of the drum stick are sturdy and durable to resist breakage. The further reduced tip portion may be rounded at its end which strikes the drum surface, or may be enlarged ball or spherical shape, if desired, so that a smooth surface is presented to the drum surface. The tip portion, also, is strong and durable and is not subject to breakage. The overall weight of the drum sticks herein presented is greater than the weight of conventional drum sticks, so that the user feels more secure and comfortable in the handling thereof.

A principal object of the invention is to provide drum sticks of improved design and utility. Another object of the invention is to provide such drum sticks which are tough and durable, yet which are sensitive and responsive to the drummer's commands. Yet another object of the invention is to provide such drum sticks which are efficient and of good balance, and which are economical in manufacture.

Other objects and advantages of the invention will appear from the following descriptions of preferred embodiments, reference being made to the accompanying drawings.

BRIEF DESCRIPTIONS OF THE DRAWINGS

FIG. 1 is a elevation of a preferred embodiment of drum stick according to the invention.

FIG. 2 is an enlarged partial side elevation of the drum stick shown in FIG. 1, taken at line 2—2 of FIG. 1.

FIG. 3 is a transverse cross section taken at line 3—3 of FIG. 2.

FIG. 4 is a partial side elevation of a modified drum stick according to the invention.

DESCRIPTIONS OF THE PREFERRED EMBODIMENTS

Referring to the drawings in detail, and first to FIGS. 1–3, the preferred form of drum stick shown therein has a cylindrical handle end section 10, which is of larger destination than the remainder of the drum stick, and an intermediate length portion 11 of which has a plurality equally longitudinally spaced surrounding grooves 12 therearound to form a non-slip grip for the drummer using the drum stick. The butt end portion 13 is smooth and ungrooved, and the end 14 is preferably convexly rounded, and may be spherical or non-spherical, as desired. The inside portion 15 of the stick is ungrooved and smooth, and joins reduced diameter stick portion 16 at shoulder 17, the entire drum stick being unitary, being made of a single elongate piece of wood.

At its terminal "working" end 18, or tip, the drum stick is further reduced in diameter, a shoulder 19 being provided between portions 16 and 18, as shown. Each portion 11, 13, 15, 16, and 18 is of cylindrical shape, to be of uniform strength throughout its length. The portions 15 and 16 of the drum stick are ideally suited for tapping on the rim of the drum housing, as is sometimes done for special effects.

The end tip portion 18 is convexly rounded at its end 20, either spherically or non-spherically, as desired. Alternatively, as shown in FIG. 4, the end portion 18 may be in the form of a spherical ball 20*a* somewhat larger in diameter than portion 18, as shown.

More than two stepdowns in diameter between the handle portions and the tip may be provided.

The angle formed by drawing a straight line through aligned points at the outer edges of shoulders 17 and 19 forms a small angle with the drum stick axis, so that the drum stick may be held relatively flat with regard to the drum surface with tip engagement with the drum surface readily attained, the same as with a conventional tapered drumstick. In other words, the stepped configuration of the drum stick does not interfere with its utility.

The drum sticks according to the invention have good balance and handling characteristics, and are well received by both amateur and professional drummers. The hand-stick friction provided by the grooves 12 is especially well-liked by drummers, as it reduces slippage of the drum stick in the hand, especially during heated musical sessions.

The grooves 12 may be of any suitable widths and depths, the preferred embodiment having grooves 1/16" wide and 1/32" deep, with ¼" center-to-center spacing between adjacent grooves.

The drum sticks may be formed of wood or of a suitable metal, such as an aluminum alloy of suitable properties.

The dimensions of drum sticks produced according to the invention may be varied, from those of larger marching sticks, to intermediate sized sticks, to the smaller orchestral sticks. Any size stick may be made according to the invention. The lengths of the stick length portions may be varied somewhat. For example, for a more flexible stick, the diameter of portion 16 may be reduced, and portion 16 may be made relatively longer, still preserving most of the strength and durability of the stick.

Manufacture of the sticks is simplified and of reduced cost, since no tapers need be formed and only inexpensive woodworking procedures need be followed.

While preferred embodiments of the invention have been described and shown in the drawings, many modifications thereof may be made by those skilled in the art without departing from the spirit of the invention, and it is intended to protect by Letters Patent all forms of the invention falling within the scope of the following claims.

I claim:

1. Drum stick, comprising a shaft of circular cross sections having plural stepwise reductions in diameter from the largest diameter handle portion at one end to the smallest diameter tip portion at the other end, each said portion along the length of the drum stick being of uniform cylindrical shape, there being at least three said portions including said handle portion and said tip portion, the terminal end of said tip portion, being convexly rounded to provide a smooth drum-contact surface.

2. The combination of claim 1, said handle portion having equally spaced ring shaped surface interruptions to provide frictional engagement by the hand.

3. The combination of claim 2, the terminal end of said handle portion being convexly rounded.

4. The combination of claim 2, said handle portion surface interruptions comprising plural axially spaced narrow circular grooves about a length of said handle portion.

5. The combination of claim 1, the terminal end of said handle portion being convexly rounded.

6. The combination of claim 1, said terminal end of said tip portion being convexly rounded in the form of an enlarged spherical ball.

7. The combination of claim 6, said handle portion having surface interruptions to provide frictional engagement by the hand.

8. the combination of claim 7, the terminal end of said handle portion being convexly rounded.

9. The combination of claim 8, said handle portion surface interruptions comprising plural axially spaced narrow circular grooves about a length of said handle portion.

10. The combination of claim 1, 2, 3, 4, 5, 6, 7, 8, or 9, said shaft being formed of metal.

11. The combination of claim 1, 2, 3, 4, 5, 6, 7, 8, or 9, said shaft being formed of wood.

* * * * *